US005235895A

United States Patent [19]

Vanark et al.

[11] Patent Number: 5,235,895

[45] Date of Patent: Aug. 17, 1993

[54] BALLISTIC ARMOR AND METHOD OF PRODUCING SAME

[75] Inventors: Virginia C. Vanark, Hazelwood; Thomas M. Ford; Carlo B. Sonnino, both of St. Louis, all of Mo.

[73] Assignee: Electronics & Space Corp., St. Louis, Mo.

[21] Appl. No.: 681,784

[22] Filed: Apr. 8, 1991

[51] Int. Cl.[5] ..... F41H 5/04; F41H 7/04

[52] U.S. Cl. ..... 89/36.02; 164/19; 164/46

[58] Field of Search ..... 89/36.01, 36.02; 164/23.19, 24, 46

[56] References Cited

U.S. PATENT DOCUMENTS

| | | | |
|---|---|---|---|
| 2,964,419 | 12/1960 | Link et al. | 89/36.02 |
| 3,670,400 | 6/1972 | Singer | 164/46 |
| 4,300,439 | 11/1981 | Degnan et al. | 89/36.02 |
| 4,632,170 | 12/1986 | Pohl | 164/46 |
| 4,704,943 | 11/1987 | McDougal | 89/36.02 |
| 4,804,034 | 2/1989 | Leatham et al. | 164/46 |
| 4,905,899 | 3/1990 | Coombs et al. | 164/46 |
| 4,907,639 | 3/1990 | Ashok et al. | 164/46 |
| 4,911,226 | 3/1990 | Cleary et al. | 164/418 |
| 4,971,133 | 11/1990 | Ashok et al. | 164/46 |

FOREIGN PATENT DOCUMENTS

| | | | |
|---|---|---|---|
| 74117 | 5/1982 | Japan | 164/46 |
| 1472939 | 5/1977 | United Kingdom . | |

*Primary Examiner*—Stephen M. Johnson

*Attorney, Agent, or Firm*—Polster, Lieder, Woodruff & Lucchesi

[57] ABSTRACT

Ballistic armor is fabricated by spraying atomized particles of molten ballistic armor metal alloy onto a collector utilizing a pressurized inert gas which impacts upon a controlled feed of the molten armor metal alloy. Dual hardness armor plate and parts are produced by spraying a second layer of a different armor metal alloy onto the first layer either before the first layer has completely solidified or while a semi-liquid surface exists on the first layer.

5 Claims, 1 Drawing Sheet

BALLISTIC ARMOR AND METHOD OF PRODUCING SAME

BACKGROUND OF THE INVENTION

The invention relates to ballistic armor and the method of producing ballistic armor.

The efficient use of ballistic armor on military or police vehicles and equipment is a basic tenant of national defense and domestic order. Inferior armor plate and parts can result in the loss of life, very expensive equipment and ultimately battle defeat.

The process involved in the production of conventional ballistic armor plate involves several steps. Ballistic armor metal alloy is liquified in an electric or gas fired furnace in large quantities and is poured into large molds or into a continuous casting machine. The ingots produced in the molds or billets produced in the continuous casting machine are preheated to the temperature needed for mechanical rolling and are passed through rolling presses many times to a proper thickness for cutting. The metal is then cut into suitably sized blanks for further heating, rolling and finishing processes. This conventional method is very time consuming, machine and labor costly and can be economically prohibitive if only a relatively small quantity of armor plate or parts need be produced for a particular application or defense contract.

Applicants have discovered that high quality ballistic armor can be produced, having at least as good and sometimes superior ballistic properties in what heretofore were considered uneconomical relatively small quantities, by utilizing molten metal spray rapid solidification techniques.

Molten metal spray rapid solidification techniques for metal production are disclosed in U.S. Pat. Nos. Re 31,767; 4,804,034 and 4,905,899, the disclosures of all of which are incorporated herein by reference. Further reference is made to United Kingdom Patent No. 1,472,939 which also discloses a method of making shaped articles from sprayed molten metal.

SUMMARY OF THE INVENTION

It is an object of the invention to apply molten metal spray rapid solidification techniques to the field of ballistic armor production.

It is another object of the invention to produce ballistic armor economically in relatively small quantities, the production of which heretofore were considered prohibitively expensive.

It is a further object of the invention to produce ballistic armor having a plurality of differing metal alloy layers of differing hardness creating ballistic armor of dual hardness.

Another object of this invention is to provide armor protection to any shape part, of relatively unlimited size easily and simply.

In general, the ballistic armor and method for producing same comprises the steps of liquifying ballistic metal alloy, transferring the metal alloy in a liquid state to a tundish, applying a controlled stream of the liquid metal from the tundish to a gas atomizer having a pressurized inert gas feed, impacting the liquid metal stream by a high velocity jet of inert gas to produce a stream of metal alloy particles, spraying the metal alloy particles onto a collector to form a dense ballistic armor preform and mechanically working the preform to finish the preform into a desired ballistic armor plate or part for use in military applications.

Dual hardness ballistic armor is produced by spraying a second layer of ballistic metal alloy of differing hardness or other characteristics onto the first layer either after the first layer has solidified or while the first layer still has a semi-liquid surface. It is also contemplated that the first layer may be mechanically textured prior to final heat treating.

These as well as other objects and advantages of the present invention will become more apparent upon a reading of the following description of the preferred embodiments of the invention in conjunction with the drawings wherein:

DETAILED DESCRIPTION OF THE PREFERRED EMBODIMENTS

Figure 1:
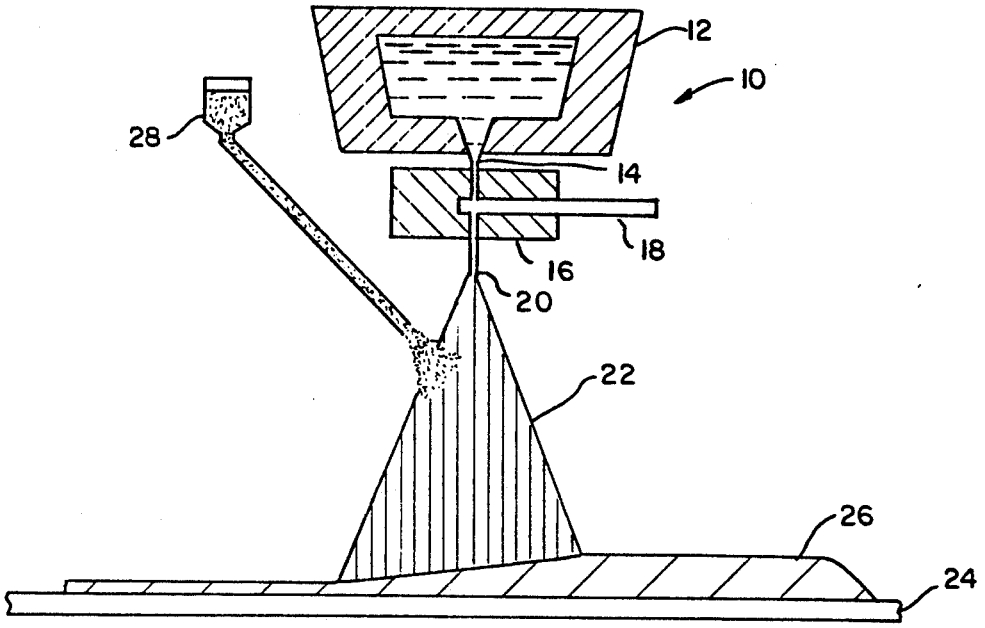
FIG. 1 is a schematic representation of a machine capable of producing ballistic armor in relatively small quantities utilizing an atomized stream of liquid ballistic armor metal alloy.

With reference to the drawings, and FIG. 1 in particular, there is schematically shown a molten metal spray rapid solidification device, generally referred to by the numeral 10, which may be employed to perform the method of the present invention to produce ballistic armor.

Rapid solidification device 10 includes a tundish 12 constructed of a ceramic material capable of holding high temperature molten metal. Ballistic armor metal alloy may be heated in a relatively small ceramic lined furnace (not shown) which may be economically constructed and operated by a defense contractor manufacturing firm, as opposed to the very large furnaces or continuous casting machines generally found only in steel mills. The relatively small quantity of molten ballistic metal alloy is poured or continuously fed into tundish 12 where it is extracted by gravity flow in a controlled stream through central bottom outlet 14 to gas atomizer 16. Gas atomizer 16 includes an inert gas feed tube 18 which communicates with the flow of molten metal through gas atomizer 16. Gases which have been used successfully in the method of the present invention are nitrogen, argon and helium. As the pressurized jet or jets of cold gas from tube 18 impacts upon the stream of molten metal passing through atomizer 16 from outlet 14, the molten metal is forced down through atomizer nozzle 20 from which it emanates as a spray, preferably conical in shape, of rapidly cooling metal droplets or particles represented by numeral 22.

Particle spray 22 is collected onto collector, or substrate, 24. Collector 24 is moved relative to nozzle 20 such that a uniform desired thickness of ballistic armor plate 26 is produced. The- particle spray 22 will, due to the kinetic energy imparted by the pressurized inert gas stream, produce a compacting of the semi-solid/semi-liquid particles which re-coalesce into a very dense semi-finished ballistic armor plate preform 26. As could be appreciated, collector 24 may be the very part for which armor protection is desired.

If desired, a particle injector 28 may be added to the system shown in FIG. 1. The injector 28 is used to inject an additive of a ceramic material into metal particle spray 22, providing for the co-deposit of the metal and ceramic particles on the collector 24 to form a metal matrix composite.

Armor plate preform 26 is then mechanically worked, for example, rolled to finish preform 26 into a desired ballistic armor shape for use in military applications, including police applications.

The preferred metal alloy particle size generated from atomizer 16 has been found to be 75 to 150 micrometers and the preferred rate of cooling of the metal alloy particles during spraying is in the range of $10^{5\circ}$ ° C./second to $10^{3\circ}$ C./second.

It is also contemplated that preform 26 may be mechanically control rolled after solidification to create a desired textured metallographic structure. The armor plate may then be heat treated to produce a hardened armor plate. Subsequently, if desired, the armor plate may be utilized as a collector itself and receive a spray of a desired thickness of second high hardness steel to produce ballistic armor of dual hardness.

Figure 2:
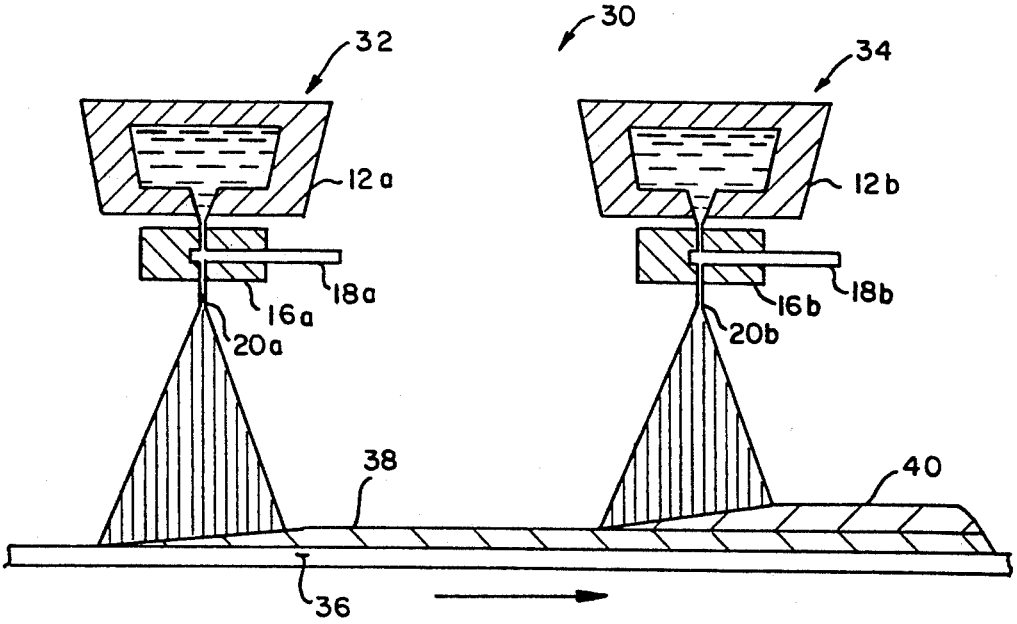
FIG. 2 is a schematic representation of a machine capable of producing ballistic armor of dual hardness.

With reference to FIG. 2 there is shown schematically an alternate rapid solidification device for producing ballistic armor plate of dual hardness generally referred to by numeral 30. Device 30 includes two rapid solidification units 32 and 34. Each of units 32 and 34 are similar to device 10 referred to hereinabove and include respective tundishes 12*a*, 12*b* and gas atomizers 16*a*, 16*b* having inert pressurized gas feed tubes 18*a*, 18*b*, respectively, associated with them. Each of units 32 and 34 is capable of producing a controlled spray of metal particles which emanate downwardly from respective nozzles 20*a*, 20*b*.

The method of producing dual hardness ballistic armor from device 30 is as follows. A first ballistic metal alloy is liquified in a relatively small furnace (not shown) and transferred in a liquid state to tundish 12*a* from which a controlled stream of liquid metal alloy is gravity fed to gas atomizer 16*a*. The liquid metal stream is impacted by one or more high velocity jets of inert gas supplied by tube 18*a* to produce a stream of metal alloy particles from nozzle 20*a* which are sprayed onto collector 36 to form a dense ballistic armor preform 38. Simultaneously, with the forming of preform 38, collector 36 is moved in the direction of the arrow to place preform 38 in position such that preform 38 may be used as a collector for a second layer of ballistic armor plate having differing ballistic characteristics from that of preform 38.

The second ballistic metal alloy is liquified and transferred to tundish 12*b*. In similar fashion the molten metal is passed through atomizer 16*b* and impacted by one or more pressurized inert gas jets from tube 18*b*. The second metal alloy is spray deposited onto preform 38 to produce a second layer of ballistic armor 40 which is fused onto preform 38. The finished product having two layers of ballistic armor of differing ballistic characteristics is then mechanically worked to produce a dual hardness ballistic armor for use in military applications including police applications. It is contemplated that the second layer 40 may be deposited on preform 38 prior to complete solidification of the upper surface of preform 38. If desired, however, layer 40 may be applied subsequent to complete solidification of preform 38. It is also contemplated that a rolling mechanism (not shown) may be incorporated between devices 32 and 34 to produce a desired textured metallographic structure for preform 38 prior to deposition of layer 40. The dual hardness armor plate having layers 38 and 40 may also be mechanically worked after solidification such as by rolling the plate to a thickness less than the deposited thickness and then heat treated, if desired.

It has been discovered that ballistic armor produced according to the principles of the present invention can provide satisfactory ballistic protection at least equal to the protection provided by armor produced by conventional methods. Further, the novel production method and the ballistic armor fabricated by the method disclosed herein facilitate the capability of producing ballistic armor in relatively small quantities making it feasible for a defense contractor manufacturing firm to produce the armor necessary to fulfill a contract on site without the drawback of placing a prohibitively large and expensive order for ballistic armor fabrication with a specialty steel mill. The result is very significant savings for the Government and ultimately the taxpayers.

It is also contemplated that with additional testing, it will be discovered that ballistic armor produced according to the methods disclosed will provide superior protection to that produced by conventional methods. The reason for this is that the size of the particles generated from the gaseous atomization vary, depending on other processing conditions. The overall particle size is in the range of 75 to 150 micrometers. The cooling rate of the particles depends on their size. Fine particles cool rapidly in flight; the cooling rate for a size less than 38 micrometers is typically $10^{5\circ}$ C./second. Larger particles cool more slowly, e.g., particles 200 micrometers in size will cool at approximately $10^{3\circ}$ C./second. Consequently, at the instant of deposition individual particles can be in one of three conditions: 1) liquid (superheated or undercooled), 2) in the semi-liquid/semisolid state, or 3) completely solidified. The larger particles tend to be liquid and the smallest solidified, with the majority being in the intermediate size in a semiliquid-semisolid condition. Therefore, during this process, there are three stages of cooling: 1) inflight cooling of $10^{5\circ}$ C. to $10^{3\circ}$ C./second depending on particle size, 2) upon deposition, extremely rapid rates of cooling, and 3) after deposition, slow cooling. Controlling the heat transfer during these stages allows the maintenance of a thin film of semiliquid-semisolid metal on the surface during formation. The dendrites formed in the particles while solidifying serve as nucleation sites for the formation of fine, equiaxed grains. Therefore the microstructure of the preform is highly homogeneous even with the differences in particle size, velocities, and temperatures. Consequently the preform may be more dense and homogeneous than those produced by conventional methods, thereby affording a greater degree of ballistic protection for any given thickness of armor plate.

EXAMPLE

Preforms of USA 4340 steel ballistic armor were produced by the rapid solidification spray forming method disclosed hereinabove. The molten steel was atomized using nitrogen gas and sprayed through a zirconia nozzle onto a collector to a thickness of 35 mm. After total solidification, the preform was rolled to a thickens of 12.5 mm and then heat treated to a Rockwell hardness of 52 to 55.

It was found that the ballistic protection afforded by the armor plate produced by this rapid solidification process was equal to that of USA 4340 armor plate produced by conventional means against 0.50 AP M2 (12.7 mm) projectiles at 30 degrees obliquity.

As numerous changes may be made to the preferred embodiments of the invention as disclosed hereinabove without departing from the spirit and scope thereof, the scope of the invention is defined solely by the following claims.

What is claimed is:

1. A method of producing ballistic armor comprising the steps of:

liquifying ballistic metal alloy;

transferring said metal alloy in a liquid state to a tundish;

supplying a controlled stream of said liquid metal alloy from said tundish to a gas atomizer having a pressurized inert gas feed;

impacting said stream by a high velocity jet of inert gas to produce a stream of metal alloy particles;

spraying said metal alloy particles onto a collector to form a dense ballistic armor preform;

cooling of the metal alloy particles during said spraying at a rate of $10^{5°}$ C./second to $10^{3°}$ C./second, and mechanically working said preform to finish said preform into a desired ballistic armor shaped for fuse in military applications.

2. The method of producing ballistic armor as specified in claim 1 wherein:

the size of metal alloy particles generated from the gaseous atomization is in the range of between 75 to 150 micrometers.

3. A method of producing relatively small quantities of specialty ballistic armor steel plate comprising the steps of:

providing a quantity of molten ballistic armor steel alloy to a tundish;

atomizing a stream of liquid ballistic armor steel onto a collector with the aid of an inert gas to form an armor preform plate;

cooling said atomized stream of liquid ballistic armor steel at a rate of $10^{5°}$ C./second to $10^{3°}$ C./second;

control rolling said plate to obtain a desired textured metallographic structure; and heat treating said plate.

4. The method of producing relatively small quantities of specialty ballistic armor as specified in claim 3 comprising the additional step of utilizing said plate as a recipient for a spray of a second quantity of molten ballistic armor steel having differing characteristics from said first mentioned steel to produce ballistic armor of dual hardness.

5. Ballistic armor formed by spraying an atomized molten metal alloy onto a collector to form a preform; cooling said atomized molten metal alloy during spraying at a rate of $10^{5°}$ C./second to $10^{3°}$ C./second; and after complete solidification of said preform, mechanically working said preform into a finished ballistic armor member.

* * * * *